US008669975B2

(12) United States Patent
Fujita

(10) Patent No.: US 8,669,975 B2
(45) Date of Patent: Mar. 11, 2014

(54) ELECTRO-OPTICAL DEVICE AND DRIVING CIRCUIT

(75) Inventor: Shin Fujita, Suwa (JP)

(73) Assignee: Japan Display West Inc., Aichi-Ken (JP)

( * ) Notice: Subject to any disclaimer, the term of this patent is extended or adjusted under 35 U.S.C. 154(b) by 1190 days.

(21) Appl. No.: 12/574,984

(22) Filed: Oct. 7, 2009

(65) Prior Publication Data

US 2010/0097369 A1 Apr. 22, 2010

(30) Foreign Application Priority Data

Oct. 17, 2008 (JP) ..... 2008-268300

(51) Int. Cl.
*G09G 5/00* (2006.01)

(52) U.S. Cl.
USPC ..... 345/213

(58) Field of Classification Search
USPC ..... 345/213
See application file for complete search history.

(56) References Cited

U.S. PATENT DOCUMENTS

| | | | | |
|---|---|---|---|---|
| 6,897,845 | B2 | 5/2005 | Ozawa | |
| 2002/0084969 | A1* | 7/2002 | Ozawa | 345/96 |
| 2003/0151572 | A1* | 8/2003 | Kumada et al. | 345/87 |
| 2006/0227096 | A1 | 10/2006 | Fujita | |
| 2008/0055300 | A1* | 3/2008 | Yamazaki | 345/212 |
| 2008/0106541 | A1* | 5/2008 | Yamazaki | 345/212 |
| 2008/0218466 | A1* | 9/2008 | Koyama et al. | 345/96 |

FOREIGN PATENT DOCUMENTS

| | | |
|---|---|---|
| JP | 05-107557 | 4/1993 |
| JP | 2000-081606 | 3/2000 |
| JP | 2002-196385 A | 7/2002 |
| JP | 2002-229519 A | 8/2002 |
| JP | 2006-313319 A | 11/2006 |
| JP | 2007-017797 | 1/2007 |
| JP | 2008-015400 | 1/2008 |
| JP | 2008-033247 | 2/2008 |
| JP | 2008-033297 | 2/2008 |
| JP | 2008-191210 | 8/2008 |

* cited by examiner

*Primary Examiner* — William Boddie
*Assistant Examiner* — Andrew Schnirel
(74) *Attorney, Agent, or Firm* — K&L Gates LLP

(57) ABSTRACT

A driving circuit of an electro-optical device, a capacitance-line-driving circuit shifting voltage of a capacitance line to one voltage of two-value voltage, and the capacitance-line-driving circuit includes a unit control circuit provided correspondingly to the capacitance line at both end portions of the capacitance line, and the unit control circuit corresponding to one capacitance line includes, a latch circuit maintaining a logic level at one level for at least a period of the scanning line corresponding to the one capacitance line being selected, a switch provided between the capacitance line and a signal line supplying a capacitance signal in which the two-value voltage is switched over at a predetermined cycle, the switch being electrically connected when the logic level is one level and electrically disconnected when the logic level is the other level.

3 Claims, 12 Drawing Sheets

ELECTRO-OPTICAL DEVICE AND DRIVING CIRCUIT

BACKGROUND

1. Technical Field

The present invention relates to an electro-optical device such as a device using liquid crystal or the like, in which a voltage amplitude of a data line is suppressed.

2. Related Art

In an electro-optical device such as a device using liquid crystal or the like, a pixel capacitance (liquid crystal capacitance) is provided at intersections between scanning lines and data lines. When an AC drive of the pixel capacitances is required, voltage of a data signal fluctuates between both polarities and therefore elements of a data-line-driving circuit supplying data signals to a data line need to have a resistance characteristic against the voltage amplitude, which is disadvantageous for power-consumption point of view. In order to suppress the voltage amplitude of a data line, there has been proposed technology in which an auxiliary capacitance is provided parallel to pixel capacitance and a capacitance line is driven with a two-value voltage in synchronization with selection of the scanning line, the capacitance line which being commonly connected to the auxiliary capacitance of each row is developed (see JP-A-2002-196358). A capacitance-line-driving circuit applying one voltage value of the two-value voltage to the capacitance line has a latch circuit operating in synchronization with selection of the scanning line, and applies one voltage value of the two-value voltage to the capacitance line according to a latch result.

SUMMARY

However, CR time constant of a capacitance line is large due to a resistance component or capacitance component. When a capacitance-line-driving circuit is provided at one side of the capacitance line, a delay occurs at the other side of the capacitance line and voltage of the capacitance line may not reach a desired voltage level rapidly. Accordingly, there has been proposed a configuration in which capacitance-line-driving circuits of same structure are provided to both sides of the capacitance line. However, when the capacitance-line-driving circuits are provided on both sides of the capacitance line, since output conditions of latch circuits provided at both sides of the capacitance line have not been settled yet, output conditions of the latch circuit immediately after applying power may be different from each other. If the output conditions are different from each other, the whole system may shutdown immediately after applying power, because a high voltage value of the two-value voltage and a low voltage value of the two-value voltage are applied to one side and the other side of the capacitance line respectively, causing a very large current to flow. An advantage of some aspects of the invention provides a technique for preventing system shutdown immediately after applying power to the system in which capacitance-line-driving circuits are provided to both sides of the capacitance line.

A driving circuit of an electro-optical device according to an aspect of the invention includes: a plurality of scanning lines; a plurality of data lines; capacitance lines provided correspondingly to the scanning lines respectively; pixels provided respectively at intersections between the scanning lines and the data lines; a scanning-line-driving circuit selecting the scanning line in a predetermined order; a data-line-driving circuit supplying a data signal with a voltage in accordance with a gray scale of pixel to a pixel corresponding to a selected scanning line; and a capacitance-line-driving circuit shifting a voltage value of a capacitance line to one voltage value of a two-value voltage when a corresponding scanning line is selected and to the other voltage value of the two-value voltage after a selection of the corresponding scanning line is terminated. Each pixel includes a pixel-switching element, one end of which is connected to the data line, and when the corresponding scanning line is selected, one end and the other end electrically connected, a pixel capacitance, one end of which is connected to the other end of the pixel-switching element, and the other end of which is connected to a common electrode, and an auxiliary capacitance interposed between one end of the pixel capacitance and the capacitance line provided correspondingly to the scanning line. The capacitance-line-driving circuit includes a unit control circuit provided correspondingly to the capacitance line at both end portions of the capacitance line. The unit control circuit corresponding to one capacitance line includes a latch circuit maintaining a logic level at one level for at least a period while the scanning line corresponding to the one capacitance line is selected and a switch provided between the capacitance line and a signal line supplying a capacitance signal in which the two-value voltage is switched over in a predetermined cycle, the switch causing electrically connected condition when the logic level is one level and causing electrically disconnected condition when the logic level is the other level. With the aspect of the invention, even if a maintaining condition of the latch circuit of the unit control circuit provided at an end of the capacitance line is different from the maintaining condition of the latch circuit provided at the other end of the capacitance line immediately after applying power, a switch of one end is turned on and the switch of the other end is turned off. Accordingly, a short circuit between two-value voltages through the capacitance line may not occur, thereby preventing a system down.

It is preferable that voltage of the capacitance signal is switched over when none of the scanning line is selected in a cycle of selecting one scanning line at a time. In this case, writing polarity can be switched over for every scanning line. Further, it is preferable that the capacitance signal has a first capacitance signal and a second capacitance signal. The first capacitance signal is switched over when none of the scanning line is selected in a cycle of selecting two scanning lines at a time. The second capacitance signal has a phase difference of 90 degrees from the first capacitance signal, and the switch of the unit control circuit in odd rows is interposed between the capacitance line and the signal line supplying the first capacitance signal and the switch of the unit control circuit in even rows is interposed between the capacitance line and signal line supplying the second capacitance signal. According to the above-described configuration, writing polarity can be turned over by selecting two scanning lines at a time. It is preferable to provide a driving circuit of an electro-optical device including a holding circuit maintaining voltage level of the capacitance line immediately before the switch in an electrically-disconnected state. In this case, deterioration of display quality can be prevented, because the capacitance line does not become high impedance state and noise effect is reduced. According to another aspect of the invention, not only a driving circuit of electro-optical device but also the electro-optical device can be conceptualized.

DESCRIPTION OF EXEMPLARY EMBODIMENTS

Hereinafter, embodiments of the invention will be described with reference to the drawings.

First Embodiment

Figure 1:
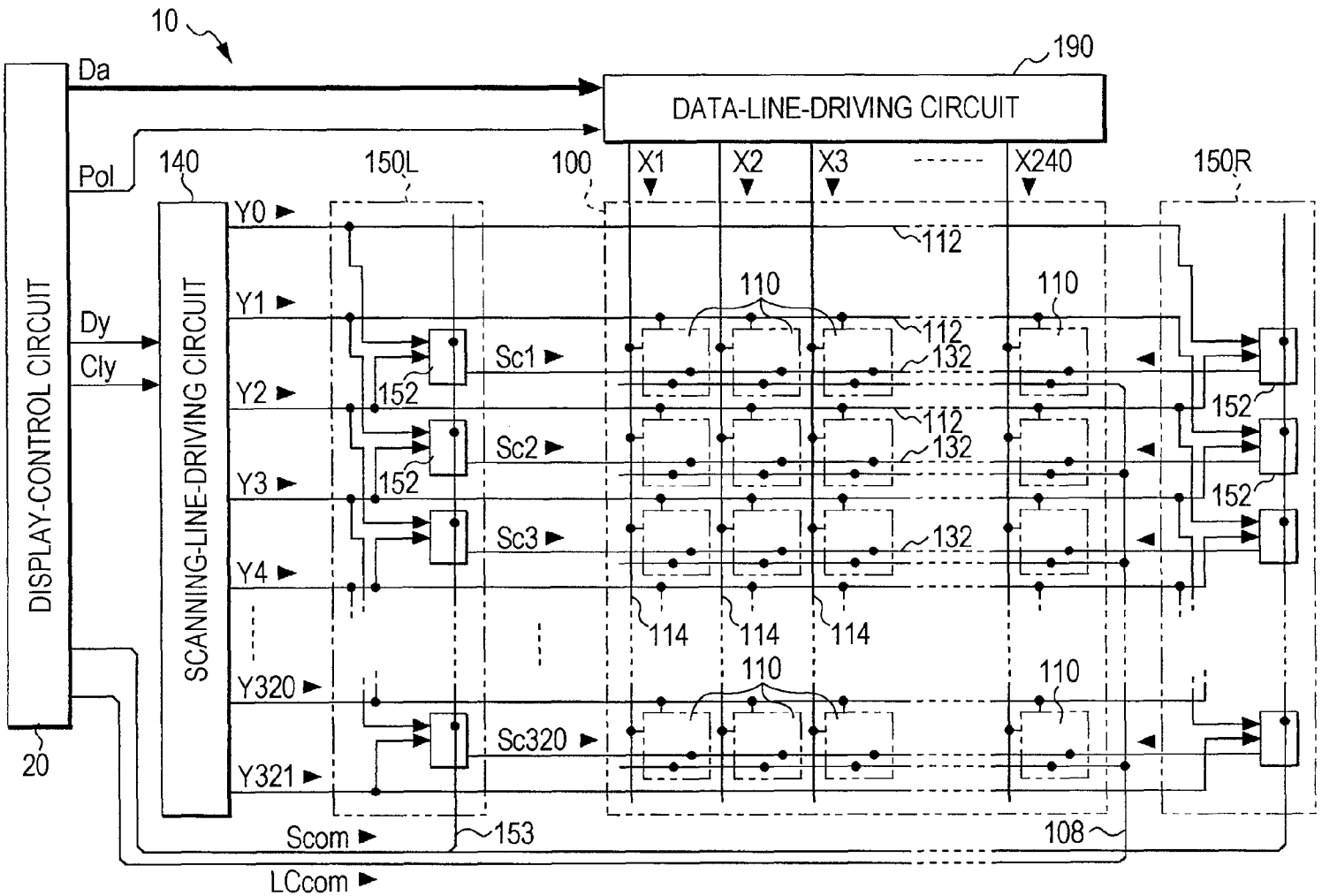
FIG. 1 is a diagram showing a configuration of an electro-optical device according to a first embodiment of the invention.

Above all, a first embodiment of the invention will be described. FIG. 1 is a block diagram showing a configuration of an electro-optical device according to the first embodiment.

As shown in FIG. 1, an electro-optical device 10 is peripheral-circuit-containing panel including a display area 100, and around the display area 100, a scanning-line-driving circuit 140, a capacitance-line-driving circuits 150L and 150R, and a data-line-driving circuit 190. Further, a display-control circuit 20 is connected to the peripheral-circuit-containing panel by, for example, a flexible printed circuit (FPC) board.

The display area 100 is an area in which pixels 110 are arranged, and in the embodiment, while scanning lines 112 of total 322 rows from row 0 to row 321 extends in the row direction in the figure, data lines 114 of 240 columns extends in the column direction.

In FIG. 1, respective pixels 110 are arranged corresponding to the intersections between the data lines 114 from column 1 to column 240 and the scanning lines 112 from row 1 to row 320 except top row 0 and bottom row 321. Therefore, in the embodiment, while the pixels 110 are arranged in the form of a 320×240 matrix in the display area 100, however the invention is not intended to be limited to this arrangement.

Since the scanning lines 112 of row 0 and row 321 are not corresponding to the pixels 110, the lines function as dummy scanning lines. Corresponding to each of the scanning lines 112 from row 1 to row 320, a capacitance line 132 extends in the row direction. Therefore, in the embodiment, the capacitance lines 132 are formed correspondingly to the scanning lines 112 from row 1 to row 320 except the row 0 and row 321 which function as dummy.

Figure 2:
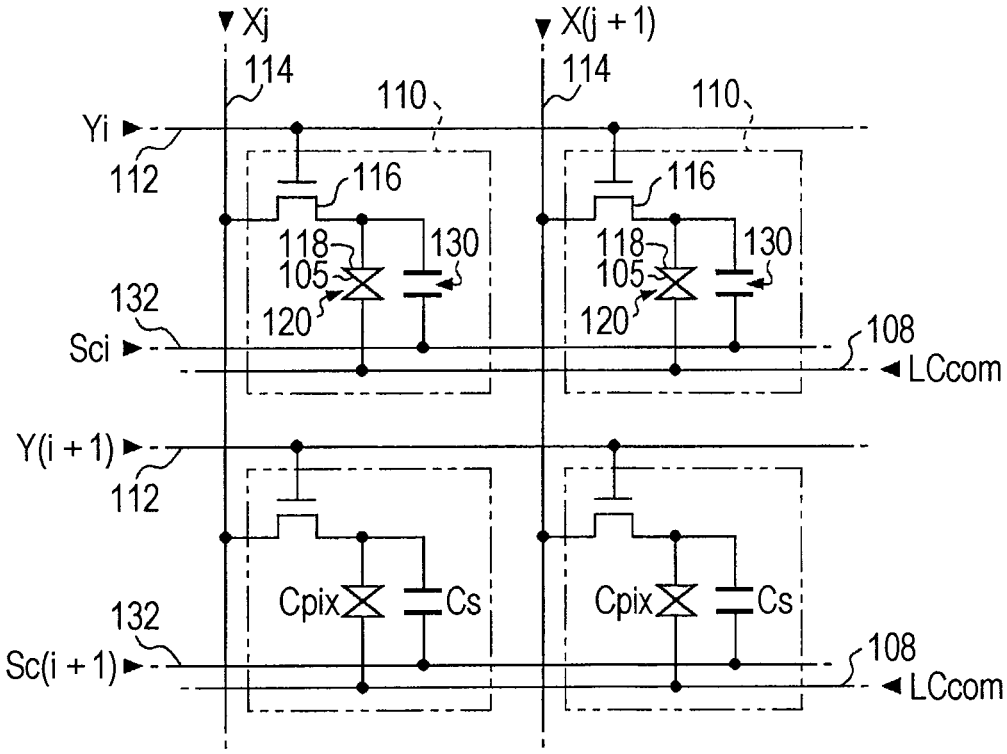
FIG. 2 is a diagram showing a configuration of a pixel in the electro-optical device.

Here, a detailed configuration of the pixel 110 will be described. FIG. 2 is a diagram showing a configuration of the pixel 110, where total four pixels in the form of 2×2 corresponding to the intersections between row i and row i+1 adjacent downwardly to the row i, and column j and column j+1 adjacent rightward to the column j are Shown. When rows for arranging the pixel 110 is described, i and i+1 are integers within the range of 1 to 320, however when rows of the scanning lines 112 are described in general, i and i+1 are integers within the range of 0 to 321, because in that case, row 0 and row 321 which are dummy need to be included. Further, j and j+1 are general symbols for representing a column in which the pixels 110 are arranged, and j and j+1 are integers within the range of 1 to 240.

As shown in FIG. 2, each pixel 110 includes a thin-film transistor (hereinafter, abbreviated as TFT) 116 of an n-channel type functioning as a pixel switching element, a pixel capacitance (liquid crystal capacitance) 120, and an auxiliary capacitance 130. Since the pixels 110 have an identical configuration with each other, a pixel at a row i and column j will be described as a representative. For the pixel 110 at the row i and column j, while a gate electrode of the TFT 116 is connected to the scanning line 112 of the row i, a source electrode of the TFT 116 is connected to the data line 114 of the column j, and a drain electrode of the TFT 116 is connected to a pixel electrode 118 that is one end of the pixel capacitance 120. The other end of the pixel capacitance 120 is connected to a common electrode 108. As shown in FIG. 1, the common electrode 108 is shared with all the pixels 110 and maintained to have a constant voltage of LCcom.

One end of the auxiliary capacitance 130 of the pixel 110 of the row i and column j is connected to the pixel electrode 118 (the drain electrode of the TFT 116), and the other end of the same is connected to the capacitance line 132 of the row i. Here, the capacitance values of the pixel capacitance 120 and the auxiliary capacitance 130 are represented as Cpix and Cs respectively. In FIG. 2, Yi and Y(i+1) represent scanning signals supplied to the scanning lines 112 of the row i and the row i+1 respectively, and Sci and Sc(i+1) represent voltages of the capacitance lines 132 of the row i and the row i+1 respectively.

The display area 100 is formed by bonding an element substrate having the pixel electrode 118 formed thereon and an opposite substrate having the common electrode 108 formed thereon such that electrode-forming surfaces face each other with a gap that is sealed with a liquid crystal 105. Accordingly, the pixel capacitance 120 is formed by sandwiching the liquid crystal 105 that is one type of a dielectric substance between the pixel electrode 118 and the common electrode 108, and a voltage difference between the pixel electrode 118 and the common electrode 108 is maintained. In this configuration, a quantity of light transmitted through the pixel capacitance 120 varies according to an effective value of a sustaining voltage. In the embodiment, for the convenience of description, the pixels 110 are assumed to be in a normally white mode in which when the effective value of a voltage sustained by the pixel capacitance 120 is close to zero, transmittance of light is maximum and white color is displayed, and when the effective value of a voltage increases, a quantity of transmitted light decreases and that black color of minimum transmittance is displayed finally.

Returning to FIG. 1, the display-control circuit 20 controls each portion in the electro-optical device 10 by outputting various control signals, supplies a capacitance signal Scom to the capacitance-line-driving circuits 150L and 150R through a signal line 153, and applies a voltage LCcom to the common electrode 108.

Figure 4:
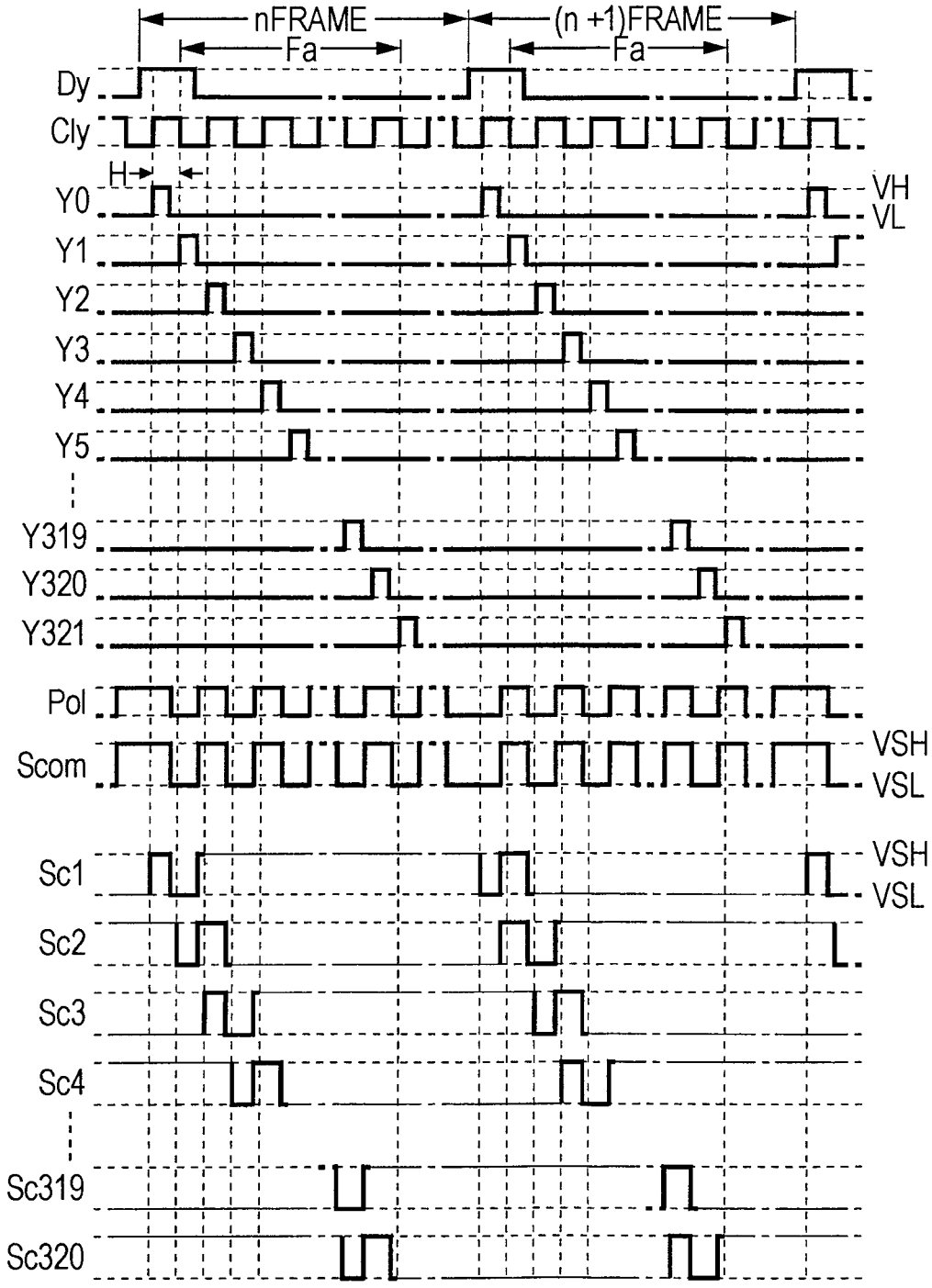
FIG. 4 is a diagram illustrating operation of the electro-optical device.

Further, as described above, around the display area 100, peripheral circuits such as the scanning-line-driving circuit 140, the capacitance-line-driving circuits 150L and 150R, the data-line-driving circuit 190 and the like are provided. The scanning-line-driving circuit 140 selects the scanning line 112 in order of row 0, row 1, row 2; row 3, . . . and row 321 counted from the top in FIG. 1 according to the control by the display-control circuit 20, and then sets a scanning signal of a selected scanning line to a select voltage VH equivalent to a level H and a scanning signal of the other scanning lines to a non-select voltage VL equivalent to a level L. In detail, as shown in FIG. 4, the scanning-line-driving circuit 140 sequentially shifts a start pulse Dy supplied from the display-control circuit 20 in accordance with a clock signal Cly having a duty ratio of 50%, and outputs scanning signals Y0, Y1, Y2, Y3, Y4, . . . , Y320 and Y321 having a pulse width narrower than half the cycle of the clock signal Cly at the start of each cycle. Here, a frame period is defined as a length of time required for displaying one frame of an image by driving the panel. When a vertical-scanning frequency is 60 Hz, then the frame period is 16.7 ms (millisecond) that is an inverse number of the vertical scanning frequency. As shown in FIG. 4, the frame period in the embodiment includes not only a vertical-effective-scanning period Fa but also a vertical blanking period, the vertical-effective-scanning period representing a period from a time when the scanning signal Y1 becomes H level to a time when the scanning signal Y320 becomes L level again. A period of half the cycle of the clock signal Cly where a logic level is constant is referred to as a horizontal-scanning period H. In the horizontal-scanning period H, a preceding period in which a scanning line signal is the level H is defined as a horizontal-effective-scanning period, and the other period is defined as a horizontal blanking period.

Next, for the convenience of description, among control signals output by the display-control circuit 20, a polarity-designation signal Pol and a capacitance signal Scom will be described. First, when the logic level of the polarity-designation signal Pol is a H level, the polarity-designation signal Pol designates a writing polarity of the horizontal-effective period as a negative polarity, and when the logic level of the polarity-designation signal Pol is a L level, the polarity-designation signal Pol designates the writing polarity of the corresponding horizontal-effective period as a positive polarity. In the embodiment, the logic level of the polarity-designation signal Pol is switched over at an interval equal to the horizontal scanning period at a time preceding to a logic level of the clock signal Cly is switched over. That is, in detail, the polarity-designation signal Pol is switched over during the horizontal blanking period in which scanning signals of adjacent two rows are all at the L level. As a result, in the embodiment, a scanning-line inversion is performed in which a writing polarity of a pixel is inverted by every single row during the frame period. The polarity-designation signal Pol is thus logically inversed compared with the same horizontal effective period of adjacent frame periods, thereby preventing liquid crystal from being deteriorated by applying a direct current component. Further, with respect to the writing polarity of the embodiment, when a voltage according to a gray scale is sustained by the pixel capacitance 120, the writing polarity is referred to as follows. When the electric potential of the pixel electrode 118 is higher than the voltage LCcom of the common electrode 108, the writing polarity is referred to as a positive polarity, meanwhile when the electric potential of the pixel electrode 118 is lower than the voltage LCcom, the writing polarity is referred to as a negative polarity. For the voltage, as long as no particular description is provided, the ground potential of an electric power supply not shown in the figures is used as a standard for zero voltage. Next, as shown in FIG. 4, the capacitance signal Scom synchronizes with the polarity-designation signal Pol, and when the polarity-designation signal Pol is the L level, then the capacitance signal Scom has a low voltage VSL of two-value voltage, and if the polarity-designation signal Pol is the H level, then the capacitance signal Scom becomes a high voltage VSH of the two-value voltage.

The data-line-driving circuit 190 provides a data signal of voltage, which is a voltage according to the gray scale of the corresponding pixel and according to the polarity designated by the polarity-designation signal Pol, to the pixel 110 located at the scanning line 112 selected by the scanning-line-driving circuit 140 through the data line 114. The data-line-driving circuit 190 performs such a supply operation for every column of 1 to 240 in selected scanning lines 112. The data-line-driving circuit 190 has substantially the following configuration. That is, the data-line-driving circuit 190 has storage areas (not shown) corresponding to a matrix of 320 rows and 240 columns, and each storage area stores display data Da designating gray scale (brightness) of corresponding pixel 110. When it is necessary to change display data, the display data Da stored in each storage area is rewritten by supplying an address and changed display data Da from the display-control circuit 20. The data-line-driving circuit 190 reads display data Da of the pixel 110 located at a selected scanning line 112 from the storage area, converts the display data into a data signal of a voltage with designated polarity, and then supplies the converted data signal to data line 114.

As shown in FIG. 1, the capacitance-line-driving circuit 150L is disposed to the left of the display area 100 and the capacitance-line-driving circuit 150R is disposed to the right of the display area 100. The capacitance-line-driving circuits 150L and 150R each have unit control circuits 152 corresponding to rows 1 to 320, and respective unit control circuits 152 drive the capacitance line 132 from both the sides thereof. Here, in the embodiment, the capacitance-line-driving circuits 150L and 150R are disposed at the right and left sides of the display area 100 respectively and have the same electrical configuration. Therefore, the electrical configuration will be representatively described with the capacitance-line-driving circuit 150L.

Figure 3:
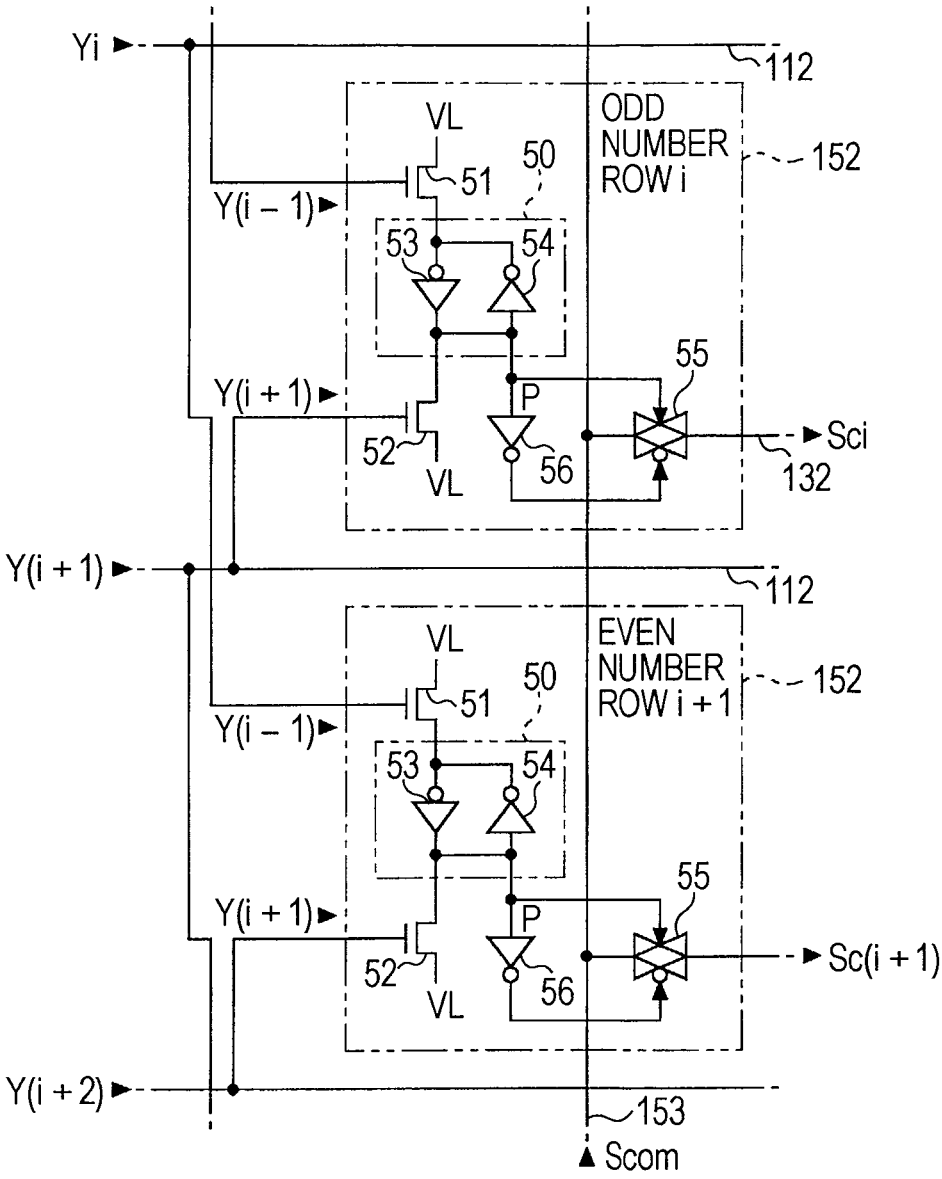
FIG. 3 is a diagram showing a configuration of a unit control circuit in the electro-optical device.

FIG. 3 is a diagram showing a configuration of a unit control circuit 152, which is corresponding to a row i and a row i+1, in the capacitance-line-driving circuit 150L. As shown in FIG. 3, the unit control circuit 152 of each row includes TFTs 51, 52, inverters 53, 54, a transmission gate 55, and an inverter 56. Among these, the unit control circuit 152 of the row i is described. Since an output terminal of the inverter 53 is connected to an input terminal of the inverter 54 and an output terminal of the inverter 54 is connected to an input terminal of the inverter 53, a latch circuit 50 having a memory characteristic is provided. Here, for the convenience, the output terminal of the inverter 53 (input terminal of the inverter 54), which is the output terminal of the latch circuit 50, is denoted by "P". A Source electrode of the TFT 51 is connected to the power supply cable of a voltage VL equivalent to a logic level of L, and a drain electrode of the TFT 51 is connected to the input terminal of the inverter 53. A gate electrode of the TFT 51 is connected to the scanning line 112 of a row i−1 which is higher than the row i by one row, so that a scanning signal Y(i−1) is supplied. On the contrary, a source electrode of the TFT 52 is connected to the power supply cable of a voltage VL and a drain electrode of the TFT 52 is connected to an input terminal of the inverter 54, and a gate electrode of the TFT 52 is connected to the scanning line 112 of the row i+1 which is lower than the row i by one row, so that a scanning signal Y(i+1) is supplied.

The transmission gate 55 is an analog switch interposed between the capacitance line 132 and signal line 153 through which the capacitance signal Scom is supplied, and when the logic level of the terminal P is a H level, the transmission gate 55 is in on-state (i.e., electrically connected), and when the logic level of the terminal P is a L level, the transmission gate 55 is in off-state (i.e., electrically disconnected). On this account, when the terminal P is the H level, the capacitance signal Scom is supplied to the capacitance line 132 by the transmission gate 55 being in the on-state. In the embodiment, since the transmission gate 55 is a complementary type obtained by combining an n channel type TFT and a p channel type TFT, the logic level of the terminal P is used as normal control signal and logic level of the terminal P inverted by the inverter 56 is used as an inversion control signal.

In this configuration, first, when a scanning signal Y(i−1) of a row i−1 becomes the H level, the TFT 51 becomes the on-state and then the L level is inverted by the inverter 53 and the terminal P in the unit control circuit 152 of the row i becomes the H level. Second, when the scanning signal Yi becomes the H level, since the scanning signal Y(i−1) has been the L level, the TFT 51 becomes the off-state, however the terminal P is maintained to be in the H level by the latch circuit 50. Third, when the scanning signal Y(i+1) becomes the H level, the TFT 52 becomes the on-state, therefore the terminal P is rewritten to the L level. Fourth, after the time when the scanning signal Y(i+1) becomes the L level, the TFT 52 becomes the off-state, however the terminal P is maintained to be in the L level by the latch circuit 50. That is, the terminal P in the unit control circuit 152 of the row i becomes the H level during two horizontal-scanning periods alone including the horizontal-scanning-effective period in which the row i itself and the row i−1 are selected, and the terminal P is maintained to be in the L level during other periods. As a result, since the transmission gate 55 in the unit control circuit 152 of the row i becomes the on-state only during the two horizontal-scanning periods and becomes the off-state during other periods, a voltage Sci of the capacitance line 132 of the row i has the same waveform as that of the capacitance signal Scom for the two horizontal-scanning periods. In addition, since parasitic capacitance components exist in each of the capacitance line 132, so that an immediately preceding voltage state is maintained even after the transmission gate 55 becomes off-state.

Accordingly, a voltage Sc1 of the capacitance line 132 of the row 1 to a voltage Sc320 of the capacitance line 132 of the row 320 is as in FIG. 4. In addition, in FIG. 4, bold lines in the waveforms of the voltages Sc1 to Sc320 are corresponding to a time period in which the transmission gate 55 is in the on-state, and thin lines are corresponding to a time period in which the transmission gate 55 is in the off-state, that is, a time period in which a voltage is maintained by the parasitic capacitance component.

Next, the operation of the electro-optical device 10 according to the embodiment will be described.

First, the scanning signal Y1 becomes the H level. Then, since the TFTs 116 of the pixels from the row 1 and column 1 to the row 1 and column 240 become the on-state, data signals X1, X2, X3, . . . and X240 are applied to the pixel electrodes 118. On this account, for the pixel capacitances 120 of the row 1 and column 1 to the row 1 and column 240, a voltage difference between the voltage of the data signal and the voltage LCcom of the common voltage 108 is written. If a polarity-designation signal Pol is the L level and therefore the positive-polarity writing is designated in the horizontal-effective-scanning period in which the scanning signal Y1 is the H level, the voltage Sc1 of the capacitance line 132 of the row 1 becomes the voltage VSL of the low-electric-potential. For this reason, in the auxiliary capacitances 130 of the row 1 and column 1 to the row 1 and column 240, a voltage difference between the voltage VSL and the voltage of the data signals is written.

Thereafter, when the scanning signal Y1 becomes the L level, the TFTs 116 of the pixels of the row 1 and column 1 to the row 1 and column 240 become the off-state. Since the polarity-designation signal Pol is inverted during the horizontal blanking period in which the scanning signal Y1 becomes the L level, the voltage Sc1 of the capacitance line 132 of the row 1 is switched over to the voltage VSH of the high-electric-potential, so that the voltage Sc1 increases by as much as VSH-VSL in comparison with the case in which the scanning signal Y1 is the H level. When the amount of the voltage increase is denoted as ΔV, in a serial connection between the pixel capacitance 120 and the auxiliary capacitance 130, under the condition that the voltage of other end (common electrode) of the pixel capacitance 120 is uniformly maintained as the voltage LCcom, the other end of the auxiliary capacitance 130 increases by as much as the voltage of ΔV. Accordingly, a voltage of the pixel electrode 118 becomes larger than that of the data signal due to the movement of electric charges. Here, assuming that the data signal Xj of a column j has a voltage Vj when the scanning signal Y1 being the H level, for the pixel 110 of the row 1 and column j, the voltage of the pixel electrode 118 which is a serial connection point between the pixel capacitance 120 and the auxiliary capacitance 130 is represented as $Vj+\{Cs/(Cs+Cpix)\}\cdot\Delta V$.

Therefore, a voltage of the pixel electrode 118 becomes larger than the voltage Vj of the data signal by as much as a value obtained by multiplying the amount of a varied voltage ΔV of the capacitance line 132 of the row 1 by the capacitance ratio $\{Cs/(Cs+Cpix)\}$ between the pixel capacitance 120 and the auxiliary capacitance 130.

In other words, when the voltage Sc1 of the capacitance line 132 of the row 1 increases by ΔV, the voltage of the pixel electrode 118 becomes larger than the voltage Vj of the data signal when the scanning signal Y1 being the H level, by as much as $\{Cs/(Cs+Cpix)\}\cdot\Delta V$ (=defined as ΔVpix). Here, the data signal Xj of the horizontal-effective-scanning period in which the positive polarity writing is designated is set to a voltage Vj obtained by presupposing that the voltage of the pixel electrode 118 increase by the voltage ΔVpix. That is, the data signal Xj is set so that the increased voltage of the pixel electrode 118 is of an electric potential higher than the voltage LCcom of the common electrode 108 and a voltage difference between the increased voltage of the pixel electrode 118 and the voltage LCcom of the common electrode 108 is set to a value according to gray scale of the row i and column j. Here, while the pixel capacitance 120 and the auxiliary capacitance 130 of the row 1 and column j have been described, the operation mentioned above is performed simultaneously and parallel in the same manner with respect to the row 1 and column 1 to the row 1 and column 240, which share the scanning line 112 and the capacitance line 132. As a result, a positive-polarity voltage according to the gray scale is maintained in each of the pixel capacitances 120 of the row 1 and column 1 to the row 1 and column 240, and the transmittance according to the gray scale is obtained.

Subsequently, the scanning signal Y2 becomes the H level. Then, since the TFTs 116 of the pixels of the row 2 and column 1 to the row 2 and column 240 become the on-state, data signals X1, X2, X3, . . . and X240 are applied to the pixel electrodes 118, a voltage difference between a voltage of the data signals and a voltage LCcom is written in the pixel capacitances 120 of the row 2 and column 1 to the row 2 and column 240. Meanwhile, since the positive polarity writing has been designated in the horizontal-scanning period in which the scanning signal Y1 is the H level, the polarity-designation signal Pol becomes the H level in the horizontal-effective-scanning period in which the scanning signal Y2 becomes the H level, thereby designating the negative polarity. As a result, a voltage Sc2 of the capacitance line 132 of the row 2 becomes the voltage VSH of high-electric-potential. Accordingly, in each of the auxiliary capacitances 130 of the row 2 and column 1 to the row 2 and column 240, a voltage difference between the voltage of the data signal and the voltage VSH is written.

Thereafter, when the scanning signal Y2 becomes the L level, the TFTs 116 of the pixels of the row 2 and column 1 to the row 2 and column 240 become the off-state. Further, during the horizontal blanking period in which the scanning signal Y2 is the L level, the polarity-designation signal Pol is inverted. Accordingly, the voltage Sc2 of the capacitance line 132 of the row 2 is switched over to the voltage VSL of low-electric-potential, and the voltage Sc2 decreases by as much as VSH-VSL, that is, the voltage ΔV, in comparison with the case in which the scanning signal Y2 is the H level. Therefore, under the condition that the voltage of the other end of the pixel capacitance 120 is uniformly maintained as the voltage LCcom, the voltage of the other end of the auxiliary capacitance 130 is reduced by as much as the voltage of ΔV, and the voltage of the pixel electrode 118 becomes smaller than that of the data signal due to movement of electric charges. Here, for a column j, in the pixel 110 of the row 2 and column j, the voltage of the pixel electrode 118 which is a serial connection point between the pixel capacitance 120 and the auxiliary capacitance 130 is represented as $$Vj-\{Cs/(Cs+Cpix)\}\cdot\Delta V.$$

Therefore, the voltage of the pixel electrode 118 becomes smaller than the voltage Vj of the data signal by as much as a value obtained by multiplying an amount of varied voltage ΔV of the capacitance line 132 of the row 2 by the capacitance ratio {Cs/(Cs+Cpix)} between the pixel capacitance 120 and the auxiliary capacitance 130.

Here, the data signal Xj of the horizontal-effective-scanning period, in which the negative polarity writing is designated, is set to a voltage Vj obtained by presupposing that the voltage of the pixel electrode 118 decrease by the voltage ΔVpix. That is, the data signal Xj of the horizontal-effective scanning period is set so that the decreased voltage of the pixel electrode 118 is of a lower electric potential than the voltage LCcom of the common electrode 108, and a voltage difference between the decreased voltage of the pixel electrode 118 and the voltage LCcom of the common electrode 108 is set to a value according to gray scale of the row i and column j. The same operation is performed simultaneously and parallel in the same manner with respect to the row 2 and column 1 to the row 2 and column 240, which share the scanning line 112 and the capacitance line 132. Accordingly, a negative-polarity voltage according to the gray scale is maintained in each of the pixel capacitances 120 of the row 2 and column 1 to the row 2 and column 240, and the transmittance according to the gray scale is obtained.

In a frame period, since the scanning signals Y1, Y2, Y3, . . . and Y320 become the H level sequentially, the same operation as that of the row 1 is performed for the row 3, 5, 7, and 319, the same operation as that of the row 2 is performed for the row 4, 6, 8, and 320. Accordingly, the positive polarity voltage according to gray scale is maintained in the pixel of odd-numbered rows and the negative polarity voltage according to the gray scale is maintained in the pixel of even-numbered rows, and the transmittance according to the gray scale is obtained respectively. In the next frame period, since the writing polarity of each row is inverted, the negative-polarity writing is designated for the pixels of odd-numbered rows and positive-polarity writing is designated for the pixels of even-numbered rows, and except this, the same operation is performed.

Figure 5:
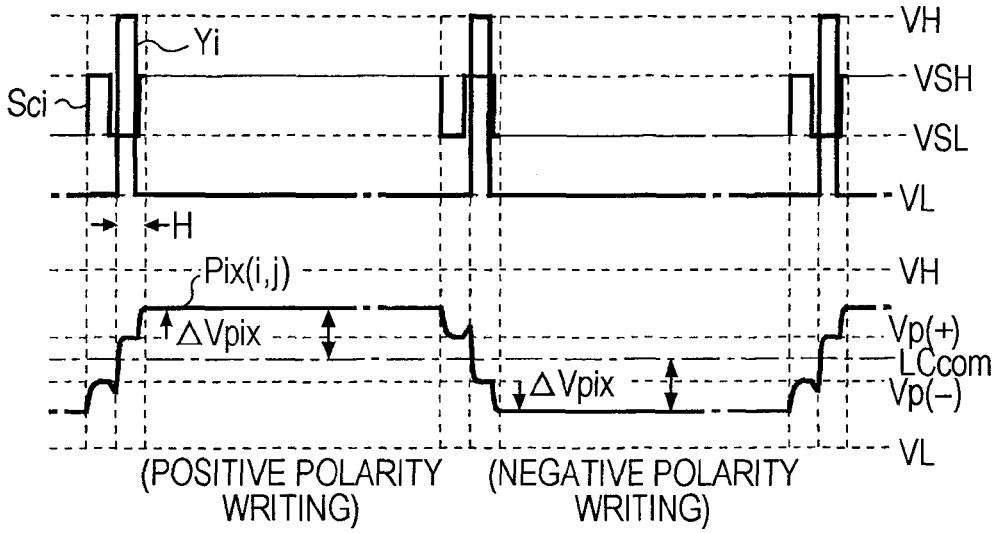
FIG. 5 is a diagram illustrating a writing operation of the electro-optical device.

FIG. 5 is a diagram showing how a voltage Pix (i, j) of the pixel electrode 118 of the row i and column j varies in association with a waveform of the scanning signal Yi of the row i and a waveform of the voltage Sci of the capacitance line of the row i. As shown in FIG. 5, when the positive-polarity writing is designated at the time when the scanning signal Y1 becomes the H level, the voltage Pix (i, j) of the pixel electrode 118 becomes a voltage Vp(+) of the data signal. Subsequently, the voltage Sci of the capacitance line 132 is switched over from the voltage VSL to the voltage VSH, causing the voltage Pix (i, j) of the pixel electrode 118 to increase by as much as ΔVpix. Further, when the negative-polarity writing is designated, the voltage Pix (i, j) of the pixel electrode 118 becomes a voltage Vp(−) of the data signal. Subsequently, the voltage Sci of the capacitance line 132 is switched over from the voltage VSH to the voltage VSL, causing the voltage Pix (i, j) of the pixel electrode 118 to reduce by as much as ΔVpix. In addition, for the row i, the voltage Sci of the capacitance line 132 is switched over by the scanning signal Y(i−1) being the H level. Therefore, the voltage of the pixel electrode 118 is also changed, however, since the voltage-change period is one horizontal-scanning period among the whole frame period, influence on the transmittance is nearly ignorable. Furthermore, in the embodiment, after the termination of selecting a scanning line, the voltage Sci of the capacitance line 132 is switched over from the voltage VSL to the voltage VSH or from the voltage VSH to the voltage VSL when the next scanning line is selected. However, an aspect of the invention is not limited thereto, and the voltage Sci of the capacitance line 132 can be switched over at any time after the termination of selecting a scanning line and before the next frame-writing starting after one vertical period from the termination.

In the embodiment, the voltage range of the pixel electrode 118 is enlarged as compared to the voltage amplitude of the data signal, conversely speaking, the voltage amplitude of the data signal may be narrower than the voltage range of the pixel electrode 118. Accordingly, not only a resistance characteristic of elements forming the data-line-driving circuit 190 may be lower, but also the voltage amplitude of the data line 114 becomes narrower, consequently, unnecessary waste of electric power by the parasitic capacitance of the data line 114 is prevented.

In the embodiment, after all the scanning signals Y1 to Y320 have become the H level at least one time, states of the terminals P maintained in the unit control circuits 152 of the rows 1 to 320 in the capacitance-line-driving circuits 150L and 150 R are confirmed. However, in a condition such as right after applying electric power, if all the scanning signals Y1 to Y320 have not become the H level, states of the terminals P maintained are not confirmed. Accordingly, in the unit control circuits 152 of the same row, there may exist a condition in which states of the terminals P maintained are different from each other. For example, with respect to the states of the terminals P maintained in the unit control circuits 152 of the same row, it is possible that while the state of the terminal P of the capacitance-line-driving circuit 150L located to the left is the H level, the state of the terminal P of the capacitance-line-driving circuit 150R located to right is the L level, or vice versa.

Figure 6A:
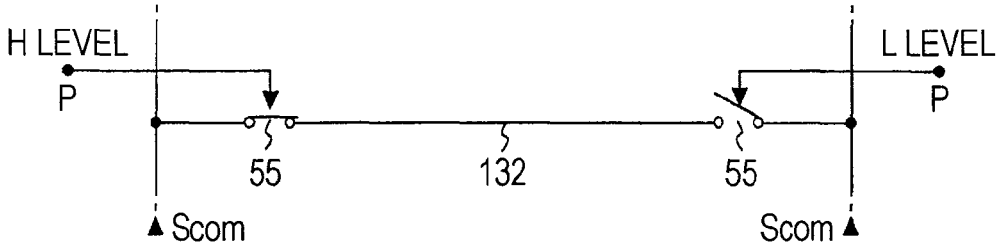
FIGS. 6A and 6B are diagrams respectively showing operations when two latch results of the unit control circuits are different from each other.
Figure 6B:
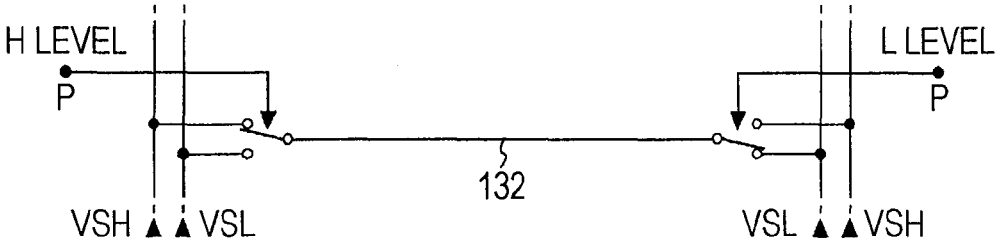

As described in the related art, there may be such a case that states of the same row are different from each other in the configuration in which voltage of the capacitance line is selected as the high-electric-potential voltage VSH or the low-electric-potential voltage VSL in accordance with the state of the latch circuit maintained. For example, as shown in FIG. 6B, when a state of the left side is the H level and a state of the right side is the L level, the voltage VSH is selected at one side of the capacitance line 132 and the voltage VSL is selected at the other side of the capacitance line 132, causing a short-circuit state and a high current flowing through the capacitance line 132. Such a short-circuit state disappears when all the scanning signals Y1 to Y320 have become the H level at least one time. However, if the electric power circuit supplying the voltages VSH and VSL does not have enough capacitance, the system may shutdown before all the scanning signals Y1 to Y320 have become the H level at least one time. With regard to this matter, in the embodiment, even though the states of the terminals P maintained at both sides are different from each other in the condition in which all the scanning signals Y1 to Y320 have not become the H level at least one time, for example, as shown in FIG. 6A, even though the state of the left side is the H level and the state of the right side is the L level, the transmission gate 55 of the level L side becomes the off-state, thereby preventing a high current flowing through the capacitance line 132. After all the scanning signals Y1 to Y320 have become the H level at least one time, the states of the terminals P maintained at both the sides become identical, and therefore there is no problem in the next operations.

Second Embodiment

Figure 7:
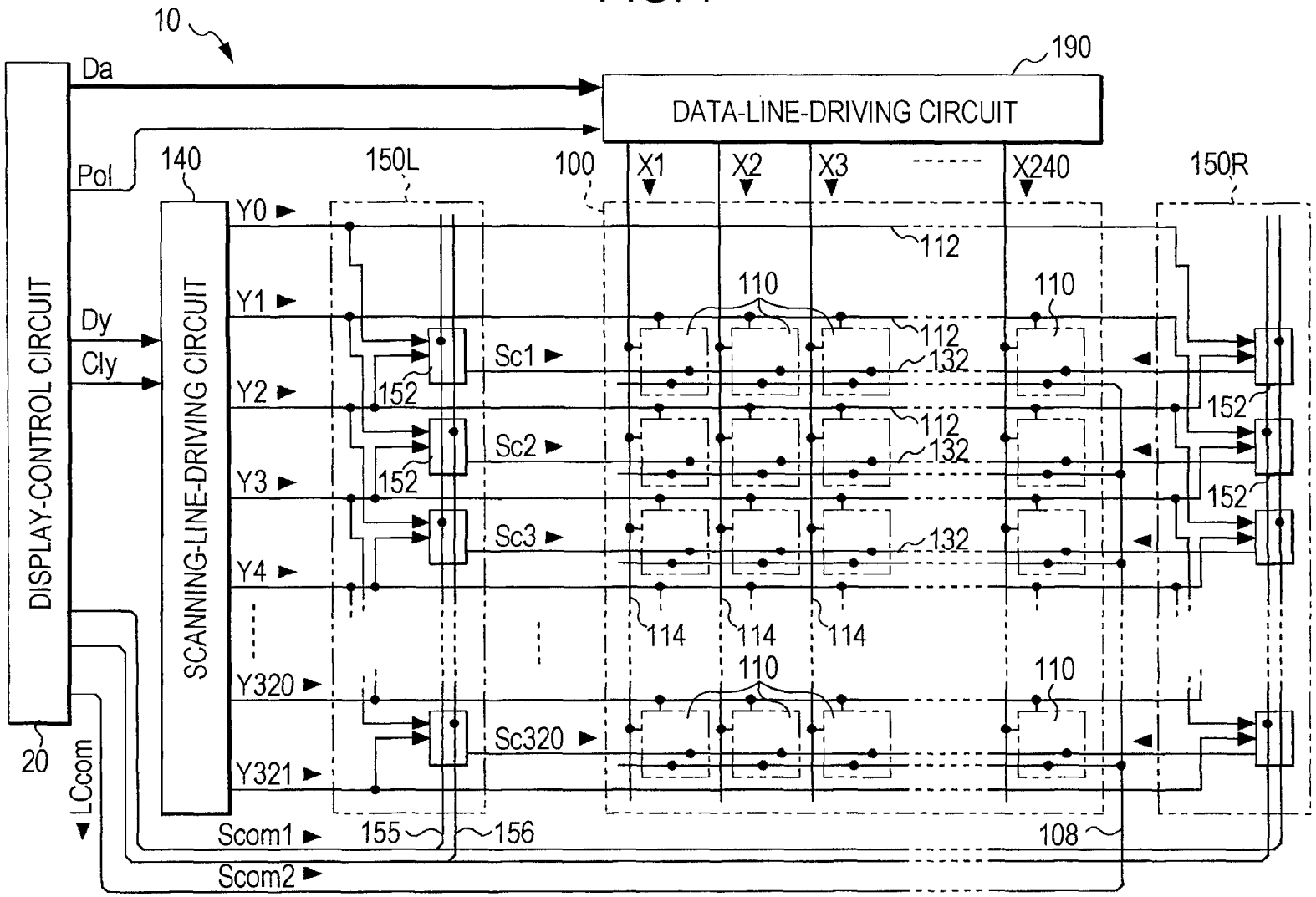
FIG. 7 is a diagram showing a configuration of an electro-optical device according to a second embodiment of the invention.

Next, an electro-optical device according to a second embodiment will be described. FIG. 7 is a block diagram showing a configuration of the electro-optical device according to the second embodiment. In the first embodiment shown in FIG. 1, while a writing polarity is inverted by one row at a time, in the second embodiment, the writing polarity is inverted by two rows at a time. Therefore, the second embodiment is different from the first embodiment in terms of two points: one is that the capacitance signal of the second embodiment includes a first capacitance signal Scom1 and a second capacitance signal Scom2 (a first difference), and the other is that in the capacitance-line-driving circuits 150L and 150R the connection relation of the unit control circuits 152 in odd-numbered rows is different from that in even-numbered rows (a second difference). Since the second embodiment has similar configurations to the first embodiment other than the above differences, the following description will be focused on the first and the second differences.

Figure 9:
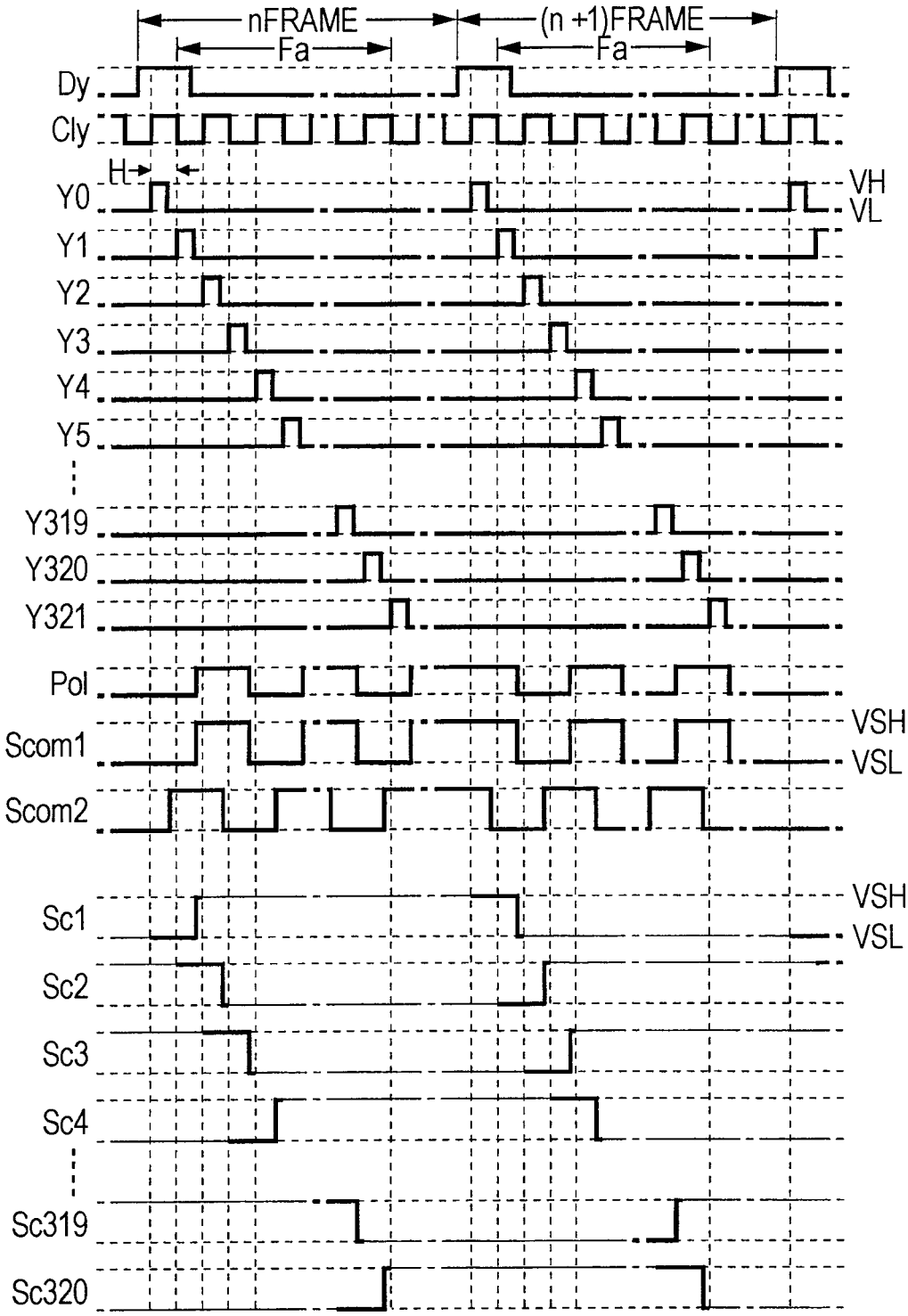
FIG. 9 is a diagram illustrating an operation of the electro-optical device.

First, as described above, in the second embodiment, since the writing polarity is inverted on a two-by-two basis, the polarity-designation signal Pol has the same logic level for the horizontal-effective-scanning period in which the row 1, rows 2 and 3, rows 4 and 5, rows 6 and 7, . . . , rows 318 and 319, and row 320 are selected, and the logic level is inverted by a period equivalent to two horizontal-scanning periods, as shown in FIG. 9. Also, similarly to the first embodiment, the logic level of the polarity-designation signal Pol is switched over at a time which precedes a time when the logic level of the clock signal Cly is switched over.

Next, the first difference will be described. As shown in FIG. 9, the first capacitance signal Scom1 becomes a voltage VSL when the polarity-designation signal Pol is the L level, and becomes a voltage VSH when the polarity-designation signal Pol is the H level. In addition, the second capacitance signal Scom2 has a phase leading the first capacitance signal Scom1 by 90 degrees (that is, lagging by 270 degrees).

Figure 8:
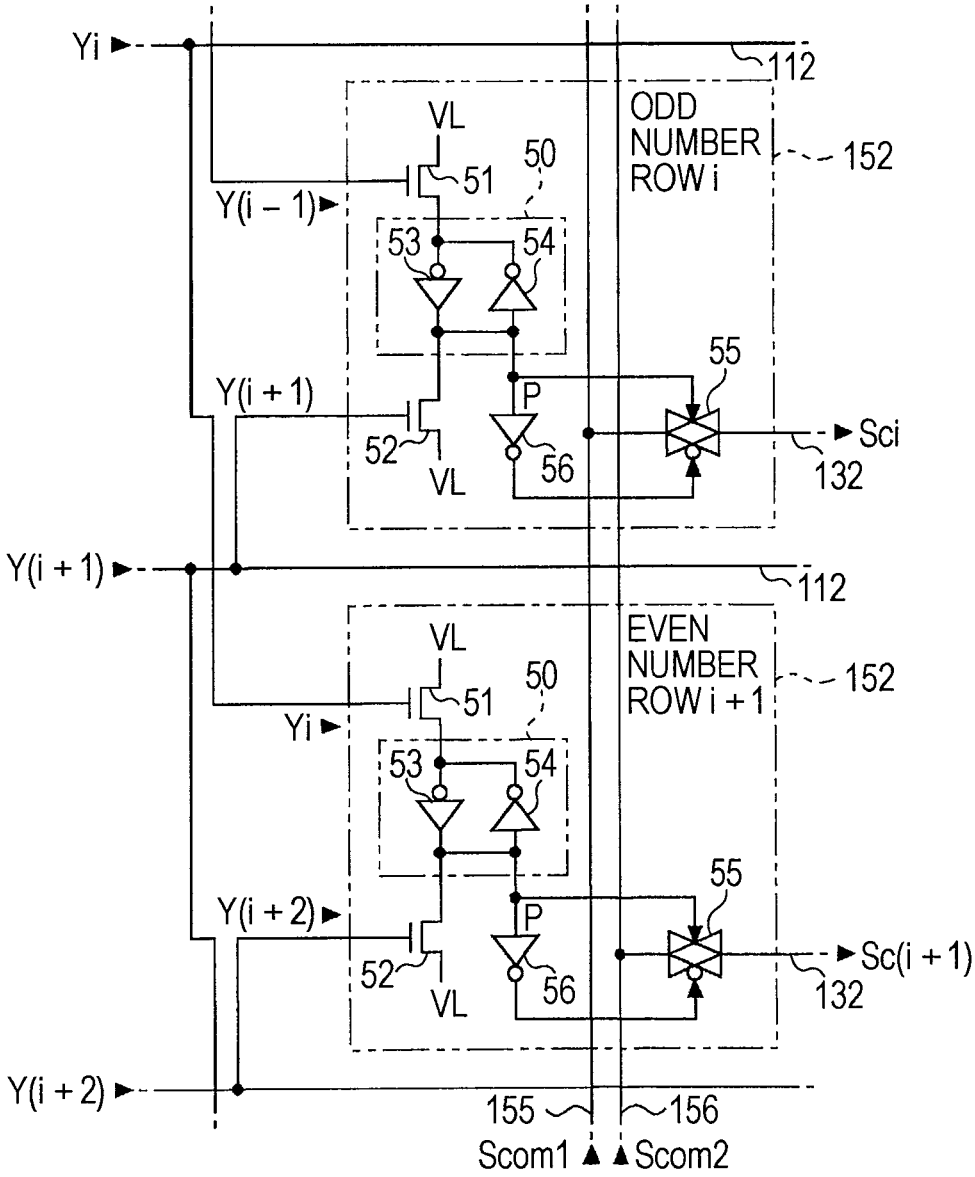
FIG. 8 is a diagram showing a configuration of a unit control circuit of a capacitance-line-driving circuit in the electro-optical device.

Subsequently, the second difference will be described. FIG. 8 is a diagram showing the configuration of the unit control circuits 152 of two rows corresponding to an odd-numbered row i and an even-numbered row i+1 that is positioned downward next to the row i of the capacitance-line-driving circuits 150L and 150R. As shown in FIG. 8, a transmission gate 55 in the unit control circuit 152 of the odd-numbered row i is interposed between a capacitance line 132 and a signal line 155 through which the first capacitance signal Scom1 is supplied, and the transmission gate 55 in the unit control circuit 152 of the even-numbered row i+1 is interposed between the capacitance line 132 and a signal line 156 through which the second capacitance signal Scom2 is supplied.

The second embodiment is identical to the first embodiment from the point of view that when the logic level of the terminal P is the H level, the transmission gate 55 shown in FIG. 8 becomes the on-state, and when the logic level of the terminal P is the L level, the transmission gate 55 becomes the off-state. Accordingly, the terminal P in the unit control circuit 152 of the odd-numbered row i becomes the H level during two horizontal-scanning periods including the horizontal-effective-scanning periods in which the row i−1 that is upward by one row and the row i are selected, and the terminal P is maintained to be the L level during other periods. As a result, the voltage Sci of the capacitance line 132 of the odd-numbered row i has the same waveform as that of the first capacitance signal Scom1 in the two horizontal-scanning period. Similarly, the terminal P in the unit control circuit 152 of the even-numbered row i+1 becomes the H level during two horizontal-scanning periods including the horizontal-effective-scanning periods in which the row i that is upward by one row and the row i+1 are selected, and the terminal P is maintained to be the L level during other periods. As a result, the voltage Sc(i+1) of the capacitance line 132 of the even-numbered row i+1 has the same waveform as that of the second capacitance signal Scom2 in the two horizontal-scanning period. Accordingly, from the voltage Sc1 of the capacitance line 132 of the row 1 to the voltage Sc320 of the capacitance line 132 of the row 320 is as shown in FIG. 9. Here, when the positive writing polarity is designated during the horizontal-effective-scanning period in which a scanning line is selected, the voltages of the capacitance lines are switched over from the voltage VSL to the voltage VSH during the horizontal blanking period after termination of the horizontal-effective period, and when the negative writing polarity is designated, the voltages of the capacitance lines are switched over from the voltage VSH to the voltage VSL during the horizontal blanking period after termination of the horizontal-effective period, and such operation is alternately performed by two rows at a time.

In addition, writing operation for each row is the same as that of the first embodiment except the following points. That is, as for a row i, the voltage Sci of the capacitance line 132 in the first embodiment is switched over when a scanning signal Y(i−1) becomes the H level and switched over again after the scanning signal Y(i−1) becomes the L level and before the scanning signal Yi of the row i becomes the H level. However in the second embodiment, the voltage Sci of the capacitance line 132 is not switched over even though the scanning signal Y(i−1) becomes the H level, however the voltage Sci of the capacitance line 132 is switched over after the scanning signal Y(i−1) becomes the L level and before the scanning signal Yi of the row i becomes the H level. As a result, in the second embodiment, since the voltage of the capacitance line 132 of the row i is not switched over even though the scanning signal Y(i−1) of the row i−1 becomes the H level, a voltage of the pixel electrode 118 is maintained as a value according to gray scale. As compared with the first embodiment, according to the second embodiment, an undesirable influence can be prevented from being posed on the transmittance.

In the second embodiment, the second capacitance signal Scom2 has a phase leading the phase of the first capacitance signal Scom1 by 90 degrees (that is, lagging by 270 degrees). Alternatively, the second capacitance signal Scom2 may have a phase lagging the first capacitance signal Scom1 by 90 degrees. When the second capacitance signal Scom2 has a phase lagging the first capacitance signal Scom1 by 90 degrees, the combination of rows having the same polarity is changed to rows 1 and 2, rows 3 and 4, rows 5 and 6, . . . , rows 319 and 320.

In driving the capacitance line, it is important in a row i to shift the capacitance line 132 by as much as voltage of ΔV when the scanning signal Yi becomes the H level and thereafter when the scanning signal Yi becomes the L level. In the first and the second embodiments, since the voltages of the capacitance signals Scom (Scom1 and Scom2) are switched over during the horizontal blanking period which is from a time when the scanning signal Yi is switched over from the H level to the L level to a time when the next scanning signal Y(i+1) is switched over from the L level to the H level, the terminal P in the unit control circuit 152 of the row i only needs to be the H level in the horizontal-scanning period in which the row i is selected. Accordingly, in the first and the second embodiments, considering only the case in which the scanning lines are sequentially selected in a direction from the top to the bottom, the scanning signal Yi may be supplied by connecting the gate electrode of the TFT 51 in the unit control circuit 152 of the row i to the scanning line 112 of the row i. However, as described below, to cope with both the cases in which the scanning line is selected in a direction from the top to the bottom or from the bottom to the top, it is preferable to connect the gate electrodes of the TFTs 51 and 52 to the scanning line of one row higher and one row lower respectively to obtain symmetry.

Third Embodiment

In the first and the second embodiment described above, for example as for a row i, the terminal P in the unit control circuit 152 is maintained at L level except two horizontal-scanning periods including horizontal-effective-scanning periods in which the row i and row i−1 are selected. On this account, except the two horizontal-scanning periods, the transmission gate 55 becomes an off-state, and therefore the capacitance line 132 is not connected to any signal line 153 (155 and 156) (high impedance state), and the voltage of the capacitance line 132 is maintained only by the parasitic capacitance or the like. Under such high impedance state, if noise or the like are superposed on the capacitance line 132, voltage of the capacitance line 132 is varied from the voltages VSH and VSL. The voltage variation of the capacitance line 132 effects on the sustaining voltage of the pixel capacitances 120 of one row which share the capacitance line 132, causing deterioration of the display quality. Therefore, the third embodiment for preventing the deterioration of display quality will be described.

Figure 10:
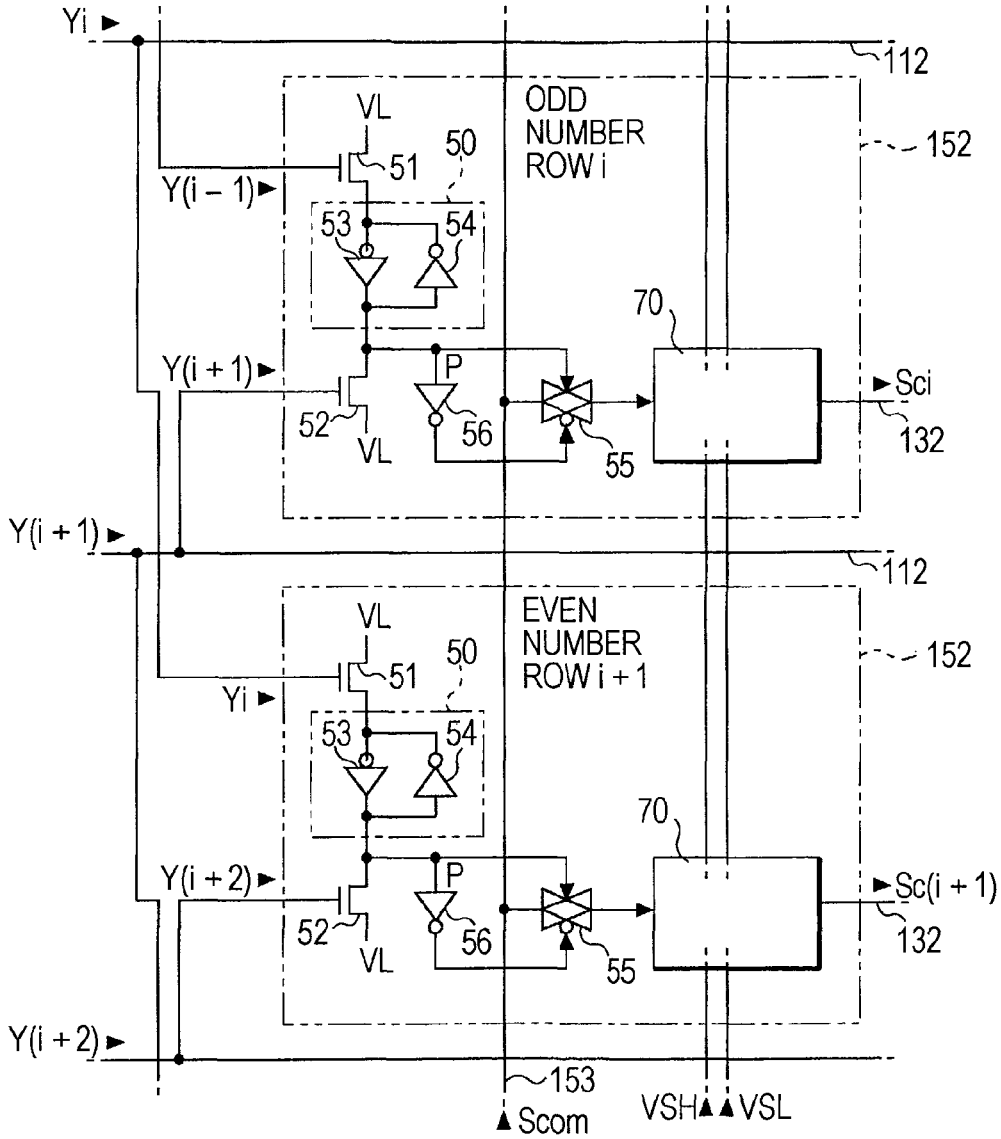
FIG. 10 is a diagram showing a configuration of a unit control circuit in an electro-optical device according to a third embodiment of the invention.
Figure 11:
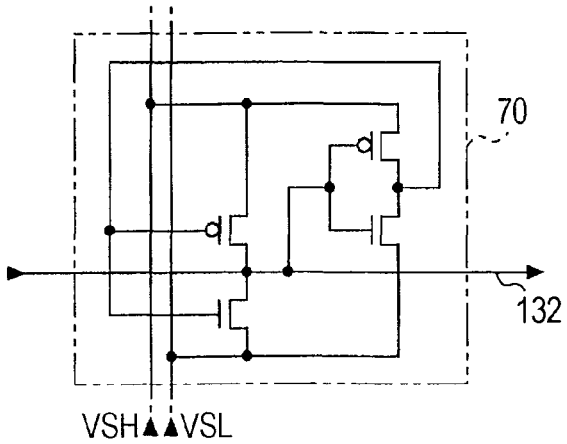
FIG. 11 is a diagram showing an example configuration of a holding circuit of the unit control circuit.

FIG. 10 is a diagram showing a configuration of a unit control circuit 152 in an electro-optical device according to the third embodiment. The unit control circuit 152 shown in FIG. 10 has a holding circuit 70 at the capacitance line 132. The holding circuit 70 maintains a voltage state immediately before the transmission gate 55 becomes the off-state. Examples of the holding circuit 70 includes a circuit shown in FIG. 11. The holding circuit 70 shown in FIG. 11 is a two-stage circuit of an inverter in which the input and output are performed through the capacitance line 132 and a low-electric-potential side of the power voltage is set to a voltage VSL and a high-electric-potential side of the same is set to a voltage VSH. A threshold voltage value of the inverter may be set between the voltage VSL and the voltage VSH. With the holding circuit 70, since the voltage VSL or voltage VSH is rewritten for the capacitance line 132 according to the voltage of the capacitance signal Scom when the transmission gate 55 becomes the on-state, and the voltage immediately before the off-state is continuously applied even though the transmission gate 55 becomes the off-state. Therefore, the capacitance line 132 does not become a high impedance state. Accordingly, it is possible to suppress the above-mentioned deterioration of display quality.

In the configuration including the holding circuit 70, at the time immediately after electric power is supplied, if a logic level of the terminals P in the unit control circuits 152 at the left side are different from that in the unit control circuit 152 at the right side, the transmission gate 55 of the level L side becomes the off-state, so that voltage of the capacitance line 132 is confirmed as the voltage of the capacitance signal Scom supplied through the transmission gate 55 of the level H side. In addition, at the time immediately after electric power is supplied, when the logic levels of the terminals P in the unit control circuits 152 are all L level at the left side and right side, an electric potential of the capacitance line 132 temporarily fluctuates. However, in the holding circuits 70 of the right side and left side, when the electric potential of the capacitance line 132 is less than the threshold value, then voltage is immediately confirmed as the VSL, and if the electric potential of the capacitance line 132 exceeds the threshold value, then voltage is immediately confirmed as the VSH respectively.

Since the holding circuit 70 is provided for maintaining voltage of the capacitance line 132 during a period except the two horizontal-scanning periods, only one holding circuit may be provided at one side instead of both the right and left sides.

Figure 12:
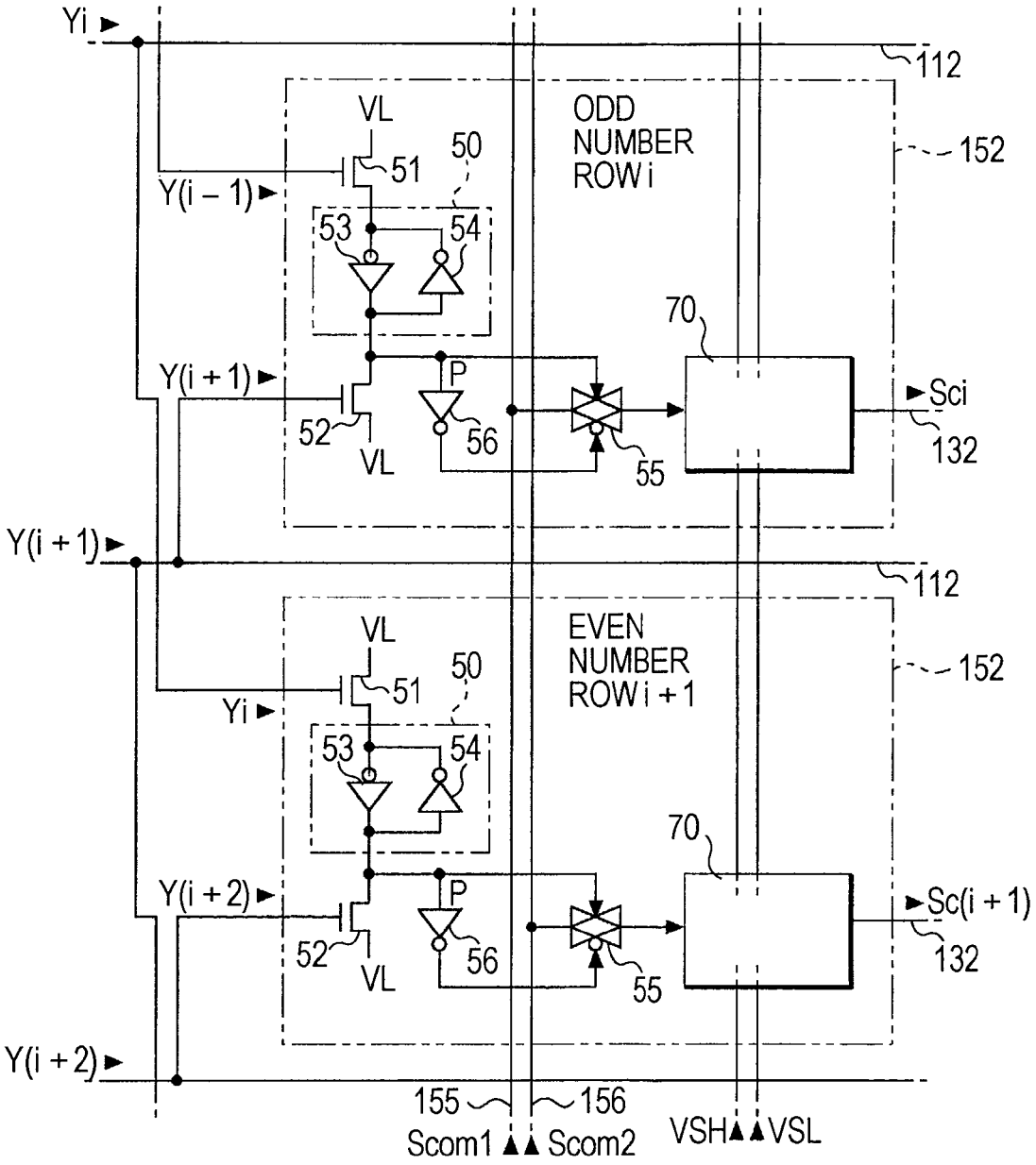
FIG. 12 is a diagram showing another configuration of the unit control circuit.

FIG. 10 shows a configuration in which the holding circuit 70 is adopted to the first embodiment shown in FIG. 3, however the holding circuit 70 may be adopted to the second embodiment shown in FIG. 8 to form a configuration shown in FIG. 12.

Application/Modification

In the above-mentioned embodiment, although the transmission gate 55 becomes the on-state when the terminal P is the H level. However, the transmission gate 55 may become the on-state when the output terminal is the L level by using the logic level of the output terminal (the input terminal of the inverter 53) of the inverter 54 as an inversion-control signal of the transmission gate 55, and supplying a normal-control-terminal signal obtained by inverting the logic level of the output terminal with the inverter.

In the above described embodiment, while the scanning line 112 is selected in the order of (row 0), row 1, row 2, row 3, . . . , row 318, row 319 and row 320, (row 321) of a direction from the top to the bottom, reverse order of (row 321), row 319, row 318, . . . , row 3, row 2 and row 1, (row 0) of a direction from the bottom to the top is also possible, and configuration able to cope with any direction is also possible. Specifically, in order to form a configuration in which the scanning line is selected in a direction from the bottom to the top, the scanning signals supplied to the gate electrodes of the TFTs 51 and 52 are interchanged in the unit control circuit 152 shown in FIG. 3 for maintaining the terminal N to be in the H level from a time when scanning signal of one-row-lower row is switched over from the L level to the H level to a time when the scanning signal of one-row-higher row is switched over from the L level to the H level. Further, in order to form a configuration able to cope with both the directions, in the case of the top-to-bottom direction, the terminal N is maintained in the H level from a time when the scanning signal of one-row-higher row is switched over from the L level to the H level to a time when the scanning signal of one-row-lower row is switched over from the L level to the H level, and in the case of the bottom-to-top direction, the terminal N is maintained in the H level from a time when the scanning signal of one-row-lower row is switched over from the L level to the H level to a time when the scanning signal of one-row-higher row is switched over from the L level to the H level.

Figure 13:
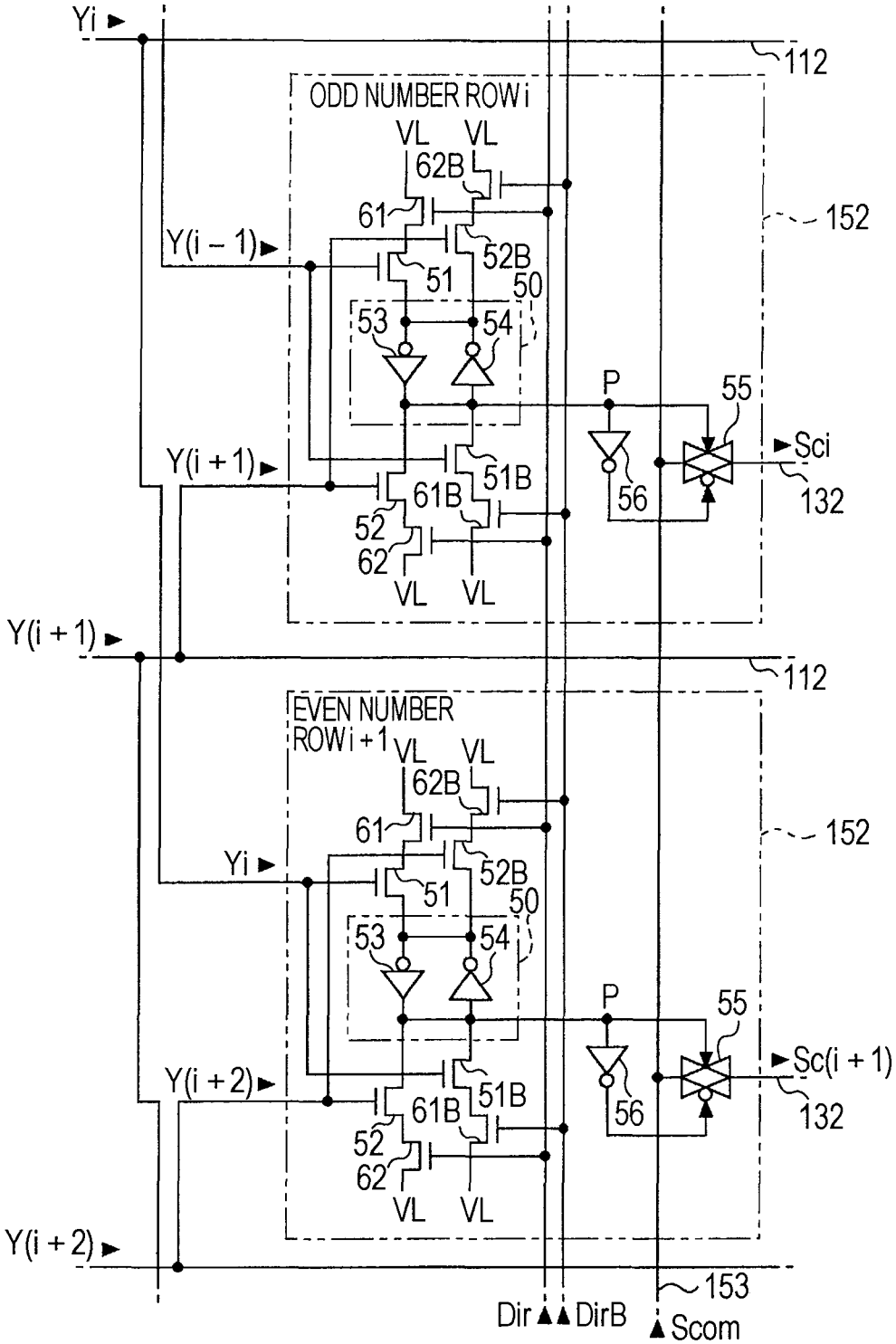
FIG. 13 is a diagram showing a configuration of a unit control circuit according to interactive transmission.

Specifically, for example, it is possible to form the configuration as shown in FIG. 13. In FIG. 13, a transmission-direction-designating signals Dir and Dir-B are signals for designating the scanning-line-selecting direction. The transmission-direction-designating signal Dir becomes H level only when the scanning lines are selected from the top to the bottom. On the contrary, the transmission-direction-designating signal Dir-B becomes H level only when the scanning lines are selected from the bottom to the top. In the configuration shown in FIG. 13, when the selection from the top to the bottom is designated, since the transmission-direction-designating signal Dir-B is the L level, TFTs 61B and 62B become the off-state and TFTs 51B and 52B become invalid, at the same time, since the transmission-direction-designating signal Dir is the H level, TFTs 61 and 62 become the on-state. As a result, from the equivalent-circuit point of view, the configuration of FIG. 13 is equivalent to that of FIG. 3. In the meanwhile, when the selection from the bottom to the top is designated, since the transmission-direction-designating signal Dir is the L level, the TFTs 61 and 62 become the off-state and TFTs 51 and 52 become invalid, at the same time, since the transmission-direction-designating signal Dir-B is the H level, the TFTs 61B and 62B become the on-state. As a result, for the unit control circuit 152 of a row i, the terminal N is maintained to be the H level from a time when the scanning signal Y(i+1) of one-row-lower row becomes the H level to a time when the scanning signal Y(i−1) of one-row-higher row becomes the H level.

FIG. 13 shows the configuration in which the transmission-direction-designation signal is adopted to the first embodiment shown in FIG. 3. However, such signal may be adopted to the second embodiment shown in FIG. 8. Further, the holding circuit 70 in the third embodiment may be adopted.

In each of the embodiments, the pixel capacitance 120 is provided by interposing the liquid crystal 105 between the pixel electrode 118 and the common electrode 108, and a direction of an electric field applied to the liquid crystal is a direction vertical to a substrate surface. However, the direction of the electric field applied to the liquid crystal may be a direction horizontal to the substrate surface by stacking the pixel electrode, an insulation layer and the common electrode. In addition, while the pixel capacitance 120 employs a normally white mode, the pixel capacitance 120 may employ a normally black mode in which no-voltage-application state causes darkness. Further, color display may be carried out by forming one dot with three pixels of red R, green G and blue B, or further adding other colors to improve color reproducibility and forming one dot with pixels of four or more colors.

As for the elements of the capacitance-line-driving circuits 150L and 150R, instead of the TFT which is the same as the pixel-switching element in the display area 100, a separate IC chip may be installed to the right and left sides. The embodiments may be of a reflection type instead of a transmission type, or a semi-transmission-reflection type formed by combination of the transmission type and the reflection type.

Electronic Apparatus

Figure 14:
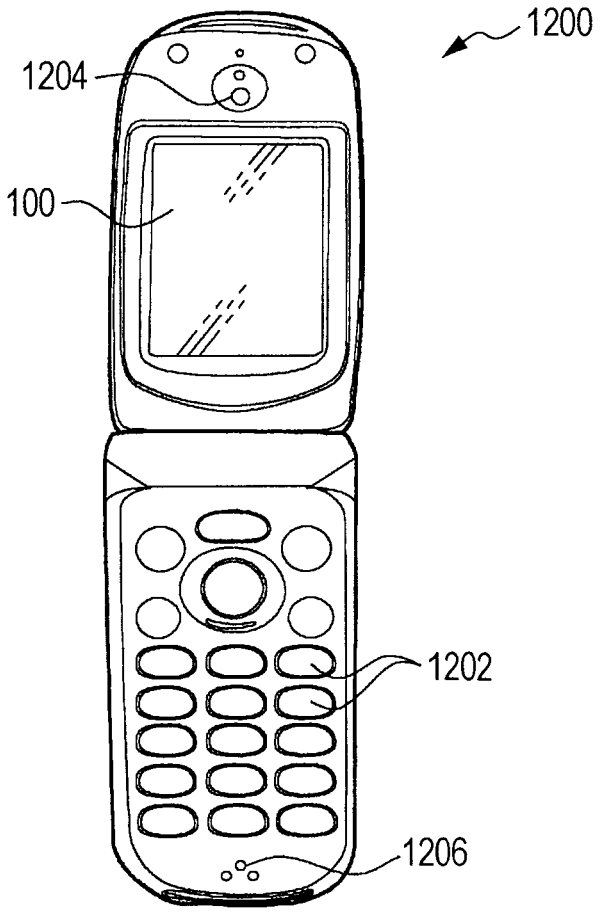
FIG. 14 shows a mobile phone unit including an electro-optical device according to an embodiment of the invention.

Hereinafter, an electronic apparatus including an electro-optical device according to the embodiments as a display device will be described. FIG. 14 shows a configuration of a mobile phone 1200 including an electro-optical device 10 according to the embodiments. As shown in FIG. 14, the mobile phone 1200 includes a plurality of operation buttons 1202, a receiving hole 1204, a transmission hole 1206, and the electro-optical device 10. Elements corresponding to the display portion 100 in the electro-optical device 10 do not appear externally.

Examples of the electronic apparatus in which the electro-optical device 10 can be applied include, other than the mobile phone illustrated in FIG. 14, digital still cameras, note-type personal computers, television receivers of liquid crystal type, video recorders of viewfinder type (or monitor direct-viewing type), vehicle navigation equipment, pagers, electronic schedulers, electronic calculators, word processors, workstations, display phones, POS terminals, apparatus including touch panels, etc. The electro-optical device 10 can be used as a display device of those apparatuses.

The entire disclosure of Japanese Patent Application No. 2008-268300, filed Oct. 17, 2008 are expressly incorporated by reference herein.

What is claimed is:

1. A driving circuit of an electro-optical device, comprising:

a plurality of scanning lines;

a plurality of data lines;

capacitance lines provided correspondingly to the scanning lines respectively;

pixels provided respectively at intersections between the scanning lines and the data lines;

a scanning-line-driving circuit selecting the scanning line in a predetermined order;

a data-line-driving circuit supplying a data signal of voltage in accordance with gray scale of a pixel through the data line to the pixel corresponding to the selected scanning line; and a capacitance-line-driving circuit shifting voltage of a capacitance line to one voltage of two-value voltage when corresponding scanning line is selected and to the other voltage of the two-value voltage after the selection period of the corresponding scanning line is terminated, wherein each pixel includes, a pixel switching element, one end of which is connected to the data line, and when the corresponding scanning line is selected, the one end and the other end is electrically connected, a pixel capacitance, one end of which is connected to the other end of the pixel switching element, and the other end of which is connected to a common electrode, and an auxiliary capacitance interposed between one end of the pixel capacitance and the capacitance line provided correspondingly to the scanning line, and the capacitance-line-driving circuit includes a unit control circuit provided correspondingly to the capacitance line at both end portions of the capacitance line, and wherein the unit control circuit includes:

a latch circuit holding a logic level at one level for at least a period of the scanning line corresponding to the one capacitance line being selected, a switch provided between the capacitance line and a signal line supplying a capacitance signal in which the two-value voltage is switched over at a predetermined cycle, the switch being electrically connected when the logic level is one level and electrically disconnected when the logic level is the other level, wherein the capacitance signal has a first capacitance signal and a second capacitance signal, voltage of the first capacitance signal is switched over at the time when none of the scanning line is selected in a cycle of selecting a polarity of the scanning lines by two rows at a time, the second capacitance signal has a phase difference of 90 degrees from the first capacitance signal, the switch of the unit control circuit of an odd-numbered row is interposed between the capacitance line and a signal line supplying the first capacitance signal, and the switch of the unit control circuit of an even-numbered row is interposed between the capacitance line and a signal line supplying the second capacitance signal.

2. The driving circuit of an electro-optical device according to claim 1, further comprising a holding circuit maintaining voltage of the capacitance line immediately before the switch being electrically disconnected.

3. An electro-optical device comprising:

a plurality of scanning lines;

a plurality of data lines;

capacitance lines provided correspondingly to the scanning lines respectively;

pixels provided respectively at intersections between the scanning lines and the data lines;

a scanning-line-driving circuit selecting the scanning line in a predetermined order;

a data-line-driving circuit supplying a data signal of voltage in accordance with gray scale of a pixel through the data line to the pixel corresponding to the selected scanning line; and a capacitance-line-driving circuit shifting voltage of a capacitance line to one voltage of two-value voltage when one corresponding scanning line is selected and to the other voltage of the two-value voltage after the selection of the corresponding scanning line is terminated, wherein each pixel includes, a pixel switching element, one end of which is connected to the data line, and when the corresponding scanning line is selected, the one end and the other end is electrically connected, a pixel capacitance, one end of which is connected to the other end of the pixel switching element, and the other end of which is connected to a common electrode, and an auxiliary capacitance interposed between one end of the pixel capacitance and the capacitance line provided correspondingly to the scanning line, and the capacitance-line-driving circuit includes a unit control circuit provided correspondingly to the capacitance line at both end portions of the capacitance line, and the unit control circuit corresponding to one capacitance line includes, a latch circuit maintaining a logic level at one level for at least a period of the scanning line corresponding to the one capacitance line being selected, a switch provided between the capacitance line and a signal line supplying a capacitance signal in which the two-value voltage is switched over at a predetermined cycle, the switch being electrically connected when the logic level is one level and electrically disconnected when the logic level is the other level, wherein the capacitance signal has a first capacitance signal and a second capacitance signal, voltage of the first capacitance signal is switched over at the time when none of the scanning line is selected in a cycle of selecting a polarity of the scanning lines by two rows at a time, the second capacitance signal has a phase difference of 90 degrees from the first capacitance signal, the switch of the unit control circuit of an odd-numbered row is interposed between the capacitance line and a signal line supplying the first capacitance signal, and the switch of the unit control circuit of an even-numbered row is interposed between the capacitance line and a signal line supplying the second capacitance signal.

* * * * *